US011036163B2

(12) United States Patent
Miyake et al.

(10) Patent No.: US 11,036,163 B2
(45) Date of Patent: Jun. 15, 2021

(54) IMAGE FORMING APPARATUS THAT DISCHARGES DEVELOPER

(71) Applicant: CANON KABUSHIKI KAISHA, Tokyo (JP)

(72) Inventors: Toshiyuki Miyake, Nagareyama (JP); Yutaka Ando, Toride (JP); Riki Fukuhara, Funabashi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/257,551

(22) Filed: Jan. 25, 2019

(65) Prior Publication Data

US 2019/0243282 A1 Aug. 8, 2019

(30) Foreign Application Priority Data

Feb. 2, 2018 (JP) ..... JP2018-017362

(51) Int. Cl.
*G03G 15/08* (2006.01)
*G03G 21/00* (2006.01)
*G03G 15/01* (2006.01)

(52) U.S. Cl.
CPC ..... *G03G 15/0822* (2013.01); *G03G 15/0121* (2013.01); *G03G 15/0126* (2013.01); *G03G 21/0011* (2013.01); *G03G 2215/0607* (2013.01)

(58) Field of Classification Search
None
See application file for complete search history.

(56) References Cited

U.S. PATENT DOCUMENTS 5,528,350 A * 6/1996 Tanaka ..... B82Y 15/00 347/155
2006/0140650 A1* 6/2006 Yokote ..... G03G 15/167 399/27

(Continued)

FOREIGN PATENT DOCUMENTS

JP 2002258573 A * 9/2002
JP 2007264398 A 10/2007

OTHER PUBLICATIONS

OKI Technical Review, "Electrophotographic Color Print Engine", vol. 64, p. 15 (Aug. 1998).*

*Primary Examiner* — Sevan A Aydin
(74) *Attorney, Agent, or Firm* — Rossi, Kimms & McDowell LLP

(57) ABSTRACT

An image forming apparatus includes a controller configured to control a first image forming unit such that while a plurality of images are being sequentially formed, a first pattern image is formed in a first sheet-to-sheet area between a first black image and a second black image among the plurality of images on a first photosensitive body, and control the second image forming unit such that while the plurality of images is being sequentially formed, a second pattern image are formed in a second sheet-to-sheet area between a first color image and a second color image among the plurality of images on a second photosensitive body. The first sheet-to-sheet area in a case where the first pattern image is formed without the second pattern image being formed is narrower than the first sheet-to-sheet area in a case where the first pattern image and the second pattern image are formed.

7 Claims, 11 Drawing Sheets

(56) References Cited

U.S. PATENT DOCUMENTS

| | | | | |
|---|---|---|---|---|
| 2009/0263150 | A1* | 10/2009 | Fujimori | G03G 15/0136 399/49 |
| 2010/0247125 | A1* | 9/2010 | Akita | G03G 15/0131 399/49 |
| 2012/0027448 | A1* | 2/2012 | Mukaibara | G03G 15/1645 399/88 |
| 2017/0269516 | A1* | 9/2017 | Sakamoto | G03G 15/1605 |

* cited by examiner

COMPUTER
905
EXTERNAL I/F
904
IMAGE CONTROL UNIT
922
PRINTER CONTROL UNIT
931
DISPLAY CONTROL UNIT
941
HIGH VOLTAGE CONTROL UNIT
311
MOTOR CONTROL UNIT
312
I/O CONTROL UNIT
313
CPU CIRCUIT UNIT
900
CPU
901
ROM
902
RAM
903

IMAGE FORMING APPARATUS THAT DISCHARGES DEVELOPER

BACKGROUND OF THE INVENTION

Field of the Invention

The present invention relates to an image forming apparatus that uses a dry-type two-component developing method.

Description of the Related Art

An electrophotographic image forming apparatus employing a dry-type developing method using a two-component developer consisted of toner and a carrier is known. In this image forming apparatus, when a number of images with low coverage rates are formed, toner is excessively charged because a developing device for which toner consumption or toner replenishment is not performed is running for a long period of time. This presents a problem that the amount of developer put on a photosensitive body per unit area decreases and also presents a problem that an external additive attached to the toner falls off due to friction with the carrier, causing degradation of print quality.

For this reason, an image forming apparatus has been proposed which adds up the number of pixels in image information, and when an integrated value exceeds a threshold value when a predetermined number of sheets or more have been printed, forms a pattern image to consume toner in a developing device (Japanese Laid-Open Patent Publication (Kokai) No. 2007-264398). In this image forming apparatus, the pattern image (hereafter referred to as a discharge pattern) formed on a photosensitive body is not transferred to a recording medium but is collected by a removal means (cleaning unit) for removing toner on the photosensitive body. Accordingly, to prevent a toner image from being transferred from the photosensitive body to an intermediate transfer body, this image forming apparatus provides control such that a high voltage for primary transfer is opposite in polarity to a bias applied in a case where an image is formed on the recording medium.

The image forming apparatus disclosed in Japanese Laid-Open Patent Publication (Kokai) No. 2007-264398 switches the primary transfer bias from a bias for normal image formation (positive bias) to a reverse bias successively in each of stations after forming the discharge pattern described above. During the switching from the positive bias to the reverse bias, a force acting on the intermediate transfer body varies, and the behavior of the intermediate transfer body temporarily are unstable in a direction (width direction) perpendicular to a conveying direction of the intermediate transfer body. For example, in the image forming apparatus has stations for four colors, assuming that the switching to the reverse bias is started in the station for the first color when primary transfer of preceding images is being performed or transfer is getting started in the stations for the third and fourth ones of the four colors. This may cause color misregistration because transfer positions in the respective stations become misaligned in a main scanning direction (width direction). Moreover, when the primary transfer bias is switched from the reverse bias back to the positive bias successively in each station so as to switch back to normal image formation again, the behavior of the intermediate transfer body also are unstable for a predetermined period of time after the switching back to the positive bias. Primary transfer of succeeding images in this unstable state may cause color misregistration.

To prevent such color misregistration, it is necessary to wait until transfer of succeeding images is completed in all the stations before formation of discharge patterns (2001 in FIG. 5A). Also, to form succeeding images after the formation of the discharge patterns, it is necessary to wait until the primary transfer bias in all the stations is switched back to the positive bias and the behavior of the intermediate transfer body stabilizes (2003, 2004 in FIG. 5A). However, this would considerably increase the waiting time and decrease productivity of image formation.

In a monochrome mode (monochrome print mode), even if primary transfer to the intermediate transfer body is done with its behavior being unstable, no color misregistration would occur because a toner image is formed and transferred in only a station for one color. If the above described measures such as waiting for transfer of preceding images and waiting for the behavior of the intermediate transfer body to stabilize are taken across the board when discharge patterns are formed in this monochrome mode, the problem of decreased productivity would remain unsolved (see FIG. 5B).

SUMMARY OF THE INVENTION

Accordingly, the present invention provides an image forming apparatus including a first image forming unit configured to have a first photosensitive body and a first developing device storing a black developer and form a black image on the first photosensitive body with the black developer in the first developing device, a second image forming unit configured to have a second photosensitive body and a second developing device storing a color developer and form a color image on the second photosensitive body with the color developer in the second developing device, an intermediate transfer body on which the black image and the color image are formed, a transfer unit configured to transfer the black image and the color image formed on the intermediate transfer body to a sheet, a first cleaner configured to remove a first pattern image used to adjust an amount of electrostatic charge on the black developer in the first developing device, a second cleaner configured to remove a second pattern image used to adjust an amount of electrostatic charge on the color developer in the second developing device, and a controller configured to control the first image forming unit such that while a plurality of images are being sequentially formed, the first pattern image is formed in a first sheet-to-sheet area between a first black image and a second black image among the plurality of images on the first photosensitive body, and control the second image forming unit such that while the plurality of images is being sequentially formed, the second pattern image are formed in a second sheet-to-sheet area between a first color image and a second color image among the plurality of images on the second photosensitive body, wherein the first sheet-to-sheet area in a case where the first pattern image is formed without the second pattern image being formed is narrower than the first sheet-to-sheet area in a case where the first pattern image and the second pattern image are formed.

According to the present invention, it is possible to selectively maintain high image quality and improve efficiency.

Further features of the present invention will become apparent from the following description of exemplary embodiments (with reference to the attached drawings).

DESCRIPTION OF THE EMBODIMENTS

An embodiment of the present invention will now be described with reference to the drawings.

Figure 1:
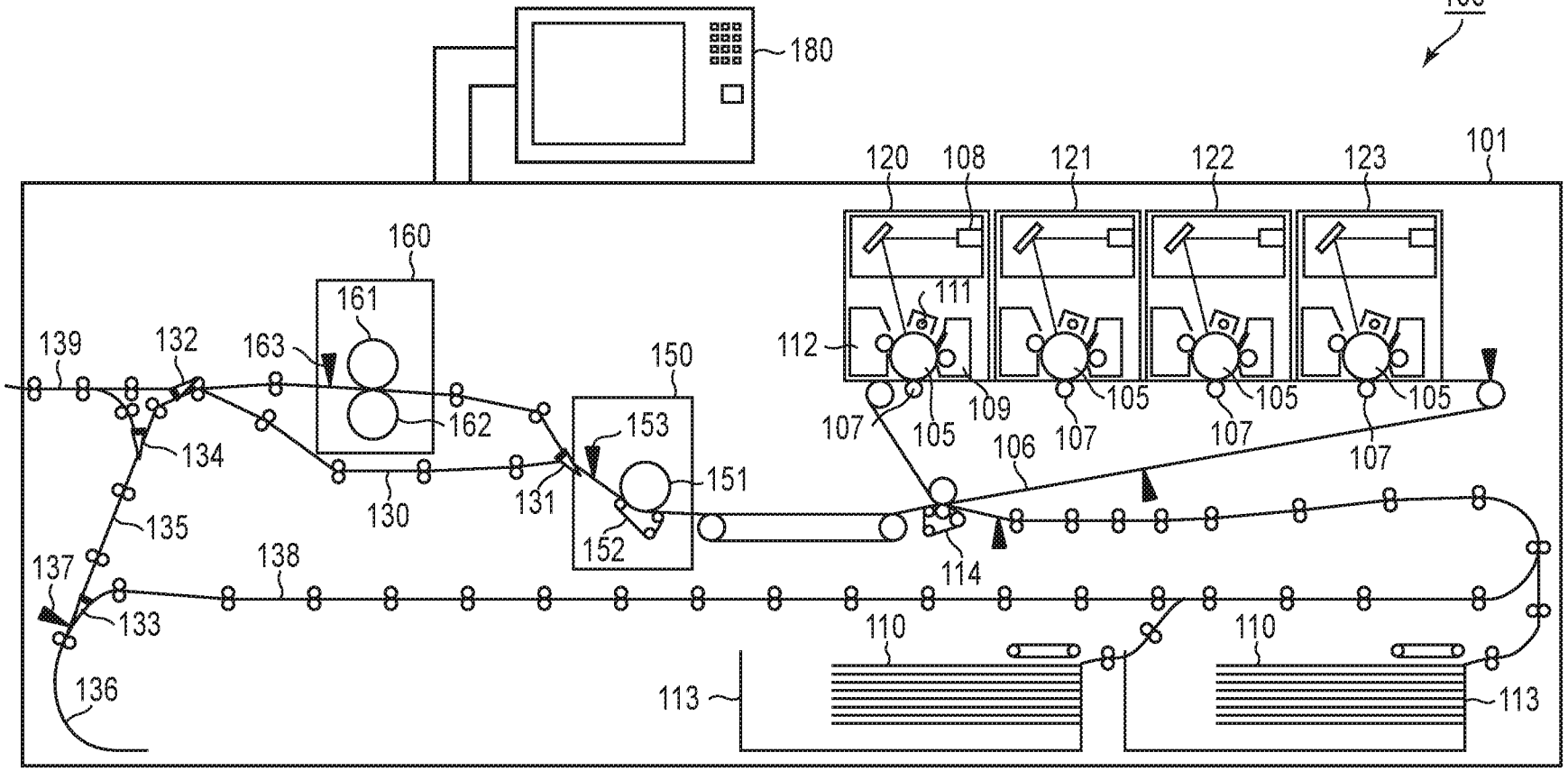
FIG. 1 is a schematic cross-sectional view of an image forming apparatus.

FIG. 1 is a schematic cross-sectional view of an image forming apparatus according to the embodiment. The image forming apparatus 100 has a cabinet 101 and an operation display device 180. The cabinet 101 houses various mechanisms constituting an engine unit. The image forming apparatus 100 is an electrophotographic color image forming apparatus for which a dry-type developing method using a two-component developer consisted of toner and a carrier is adopted.

Letters Y, M, C, and K used in the following description are abbreviations of yellow, magenta, cyan, and black, respectively. The engine unit has four stations 120, 121, 122, and 123 for Y, M, C, and K, respectively. The stations 120, 121, 122, and 123 are image forming units that form images by transferring toner to a recording sheet 110. The stations 120, 121, 122, and 123 are consisted of substantially common parts, and hence an arrangement of only the station 120 will be described as a typical example.

Photosensitive drums 105, which are photosensitive bodies, are electrically charged to a uniform surface potential by primary electrostatic chargers 111. Latent images (electrostatic images) are formed on the photosensitive drums 105 by laser light output from lasers 108. Developing devices 112 develop the electrostatic images with color materials (toner) to form toner images on the photosensitive drums 105 (photosensitive bodies). The toner images (visible images) are transferred onto an intermediate transfer belt 106, which is an intermediate transfer body, by primary transfer rollers 107 which are first transfer units. The visible images formed on the intermediate transfer belt 106 are transferred onto the recording sheet 110, which has been conveyed from a housing cassette 113, by a secondary transfer belt 114.

A fixing process mechanism has a first fixing device 150 and a second fixing device 160 and heats and pressurizes the toner images transferred onto the recording sheet 110 and fixes them on the recording sheet 110. The first fixing device 150 includes a fixing roller 151 for applying heat to the recording sheet 110, a pressurization belt 152 for bringing the recording sheet 110 into pressure contact into the fixing roller 151, and a first post-fixing sensor 153 that detects completion of fixing. The fixing roller 151 is a hollow roller and has a heater therein. The second fixing device 160 is disposed downstream of the first fixing device 150 in a direction in which the recording sheet 110 is conveyed. The second fixing device 160 gives a gloss to and reliably fixes the toner images fixed on the recording sheet 110 by the first fixing device 150. As with the first fixing device 150, the second fixing device 160 has a fixing roller 161, a pressurization belt 162, and a second post-fixing sensor 163. Some types of the recording sheet 110 do not need to pass through the second fixing device 160. In this case, for the purpose of reducing energy consumption, the image forming apparatus 100 passes the recording sheet 110 through a conveying path 130 without causing it to pass through the second fixing device 160.

For example, when a setting that gives a large amount of gloss to the recording sheet 110 has been made or when the recording sheet 110 is a thick sheet which needs a large amount of heat so as to be fixed, the recording sheet 110 that has passed through the first fixing device 150 is conveyed to the recording sheet 110 as well. On the other hand, when the recording sheet 110 is a thin sheet or an ordinary sheet and the setting that gives a large amount of gloss to the recording sheet 110 has not been made, the recording sheet 110 is conveyed to the conveying path 130 detouring around the second fixing device 160. Whether to convey the recording sheet 110 to the second fixing device 160 or cause the recording sheet 110 to detour the second fixing device 160 is controlled by switching a flapper 131 controlled by a motor control unit 312 (FIG. 2), to be described later.

All of flappers 132, 133, and 134 are guiding members for switching conveying paths under the control of the motor control unit 312. The flapper 132 guides the recording sheet 110 to an output path 135 or to an output path 139 leading to outside. A leading end of the recording sheet 110 guided to the output path 135 passes through an inversion sensor 137 and is conveyed to an inversion unit 136. When the inversion sensor 137 detects a trailing end of the recording sheet 110, the conveying direction for the recording sheet 110 is switched. The flapper 133 guides the recording sheet 110 to an output path 138 for double-sided image formation or to the output path 135. The flapper 134 guides the recording sheet 110 to the output path 139 leading to outside. The recording sheet 110 conveyed to the output path 139 is output from the image forming apparatus 100.

Figure 2:
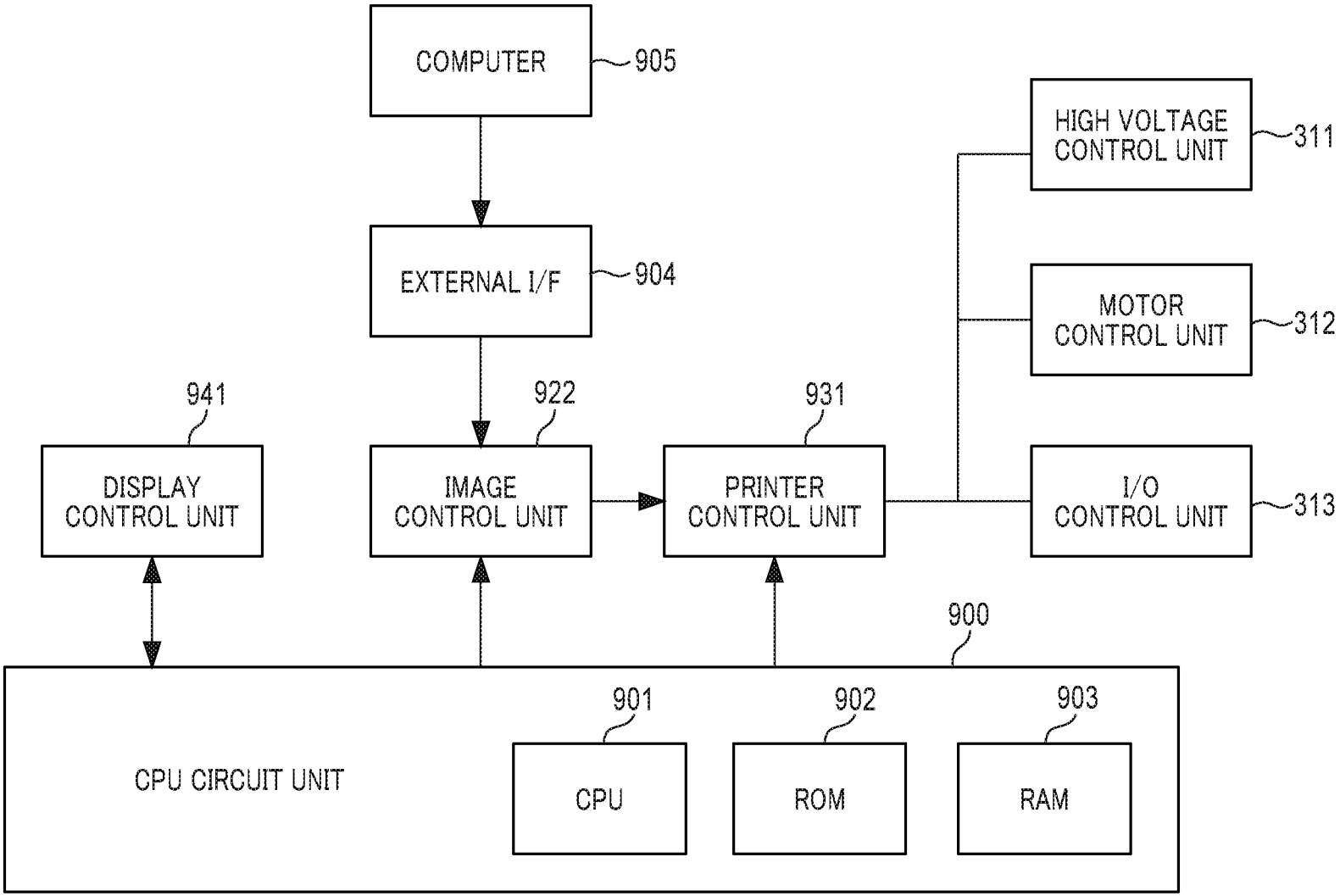
FIG. 2 is a block diagram of a controller.

Next, referring to FIG. 2, a description will be given of an arrangement of a controller that performs a role in controlling the entire image forming apparatus 100. FIG. 2 is a block diagram of the controller. As shown in FIG. 2, the controller has a CPU circuit unit 900, which incorporates a CPU 901, a ROM 902, and a RAM 903. The CPU 901 integratedly controls an image control unit 922, a printer control unit 931, and a display control unit 941 in accordance with control programs stored in the ROM 902. The RAM 903 temporarily holds control data and is used as a work area for computation processes involved in control by the CPU 901.

The image control unit 922 carries out a variety of processes on a digital image signal input from a computer 905 via an external I/F 904, converts the digital image signal into a video signal, and outputs the video signal to the printer control unit 931. Processing operations performed by the image control unit 922 are controlled by the CPU circuit unit 900. The CPU circuit unit 900 forms images and makes various adjustments, to be described later, via the printer control unit 931.

Connected to the printer control unit 931 are a high-voltage control unit 311 for controlling various high voltages, the motor control unit 312 for driving various motors, and an I/O control unit 313 for controlling I/O (input and output) to and from various sensors. The high-voltage control unit 311 provides control to apply biases to the primary transfer rollers 107 in the respective stations used in the image forming apparatus 100, a secondary transfer roller 1061 (secondary transfer unit) inside the secondary transfer belt 114, a bias roller 1142 (to be described later with reference to FIG. 3), and so forth. The motor control unit 312 controls a plurality of motors, flappers, and so forth used in the image forming apparatus 100. Conveying rollers and others are connected to the respective motors. Sensors including a conveyance sensor are connected to the I/O control unit 313, and the CPU 901 is notified of changes in sensor signals via the I/O control unit 313 and the printer control unit 931.

The high-voltage control unit 311 applies a predetermined bias to the primary transfer roller 107 (FIG. 1) provided in each of the stations 120 to 123. To feed a transfer current for transferring a toner image on the photosensitive drum 105 to the intermediate transfer belt 106, the high-voltage control unit 311 applies a positive bias (for example, about +2000 V) to the primary transfer roller 107. An electrostatic force arising from the transfer current transfers the toner image to the intermediate transfer belt 106. On the other hand, in the present embodiment, "discharge control" is carried out so as to discharge a degraded developer by consuming the developer. When this discharge control is carried out, the CPU circuit unit 900 provides control to collect and remove the toner image with a drum cleaner 109, which is a removal unit, without transferring the toner image formed on the photosensitive drum 105 to the intermediate transfer belt 106. Accordingly, the high-voltage control unit 311 applies a reverse bias (for example, about −500 V) to the primary transfer roller 107.

The secondary transfer belt 114 is subjected to a cleaning process by a cleaning mechanism, to be described later with reference to FIG. 3. However, there is a limit to the density of a toner image on the secondary transfer belt 114 which can be cleaned, and if toner remaining without being completely removed contaminates the secondary transfer belt 114, for example, the reverse side of a sheet tends to become dirty. To avoid this, in the discharge control according to the present embodiment, the CPU circuit unit 900 forms a discharge pattern, which is a pattern image for the discharge control, on the photosensitive drum 105. Then, the CPU circuit unit 900 provides control to apply the reverse bias to the primary transfer roller 107 so that the discharge pattern remaining without being transferred to the intermediate transfer belt 106 can be removed. In addition to this, there may be cases where the discharge pattern cannot be completely removed by passing it through the drum cleaner 109 only once, the CPU circuit unit 900 provides control so as not to start image formation for a next page until the photosensitive drum 105 makes one more full rotation.

Figure 3:
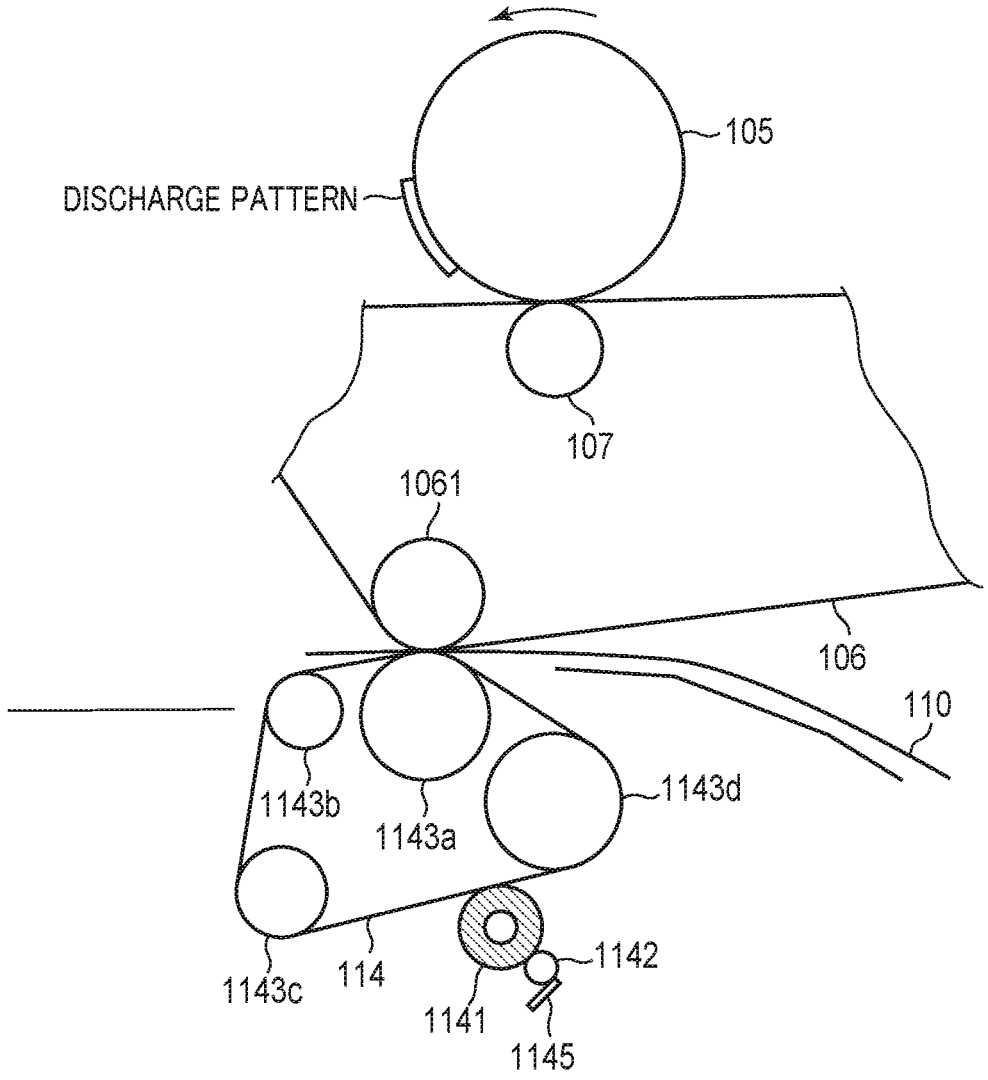
FIG. 3 is an enlarged view of a secondary transfer unit and its vicinity.

FIG. 3 is an enlarged view of the secondary transfer unit and its vicinity. In the secondary transfer unit, the secondary transfer roller 1061 is inscribed in the intermediate transfer belt 106. A predetermined bias (for example, about −3000 V) is applied to the secondary transfer roller 1061. An outer roller 1143*a* and tension rollers 1143*b*, 1143*c*, and 1143*d* are inscribed in the secondary transfer belt 114. The outer roller 1143*a* is electrically grounded. The outer roller 1143*a* faces the secondary transfer roller 1061 across the intermediate transfer belt 106. A toner image on the intermediate transfer belt 106 (i.e. on the transfer body) is transferred onto the recording sheet 110, which is a recording medium, through an electrostatic force arising from a predetermined transfer current fed from the outer roller 1143*a* to the secondary transfer roller 1061.

A cleaner fur 1141 is provided on an outer peripheral side of the secondary transfer belt 114. A bias roller 1142 is provided in contact with the cleaner fur 1141, and a cleaner blade 1145 is provided in contact with the bias roller 1142. A predetermined bias (for example, about +1000 V) is applied to the bias roller 1142. The cleaner fur 1141, the bias roller 1142, and the cleaner blade 1145 constitute a cleaning mechanism for collecting and removing toner remaining on the intermediate transfer belt 106 after being transferred to the secondary transfer belt 114. Here, the toner on the intermediate transfer belt 106 includes a measurement image for use in auto registration control and remaining toner that remains on the intermediate transfer belt 106 without being completely transferred to the recording sheet 110 during image formation. The auto registration control is to correct for a shift in the timing of image writing in the stations and adjust the tilt of an image.

Figure 4:
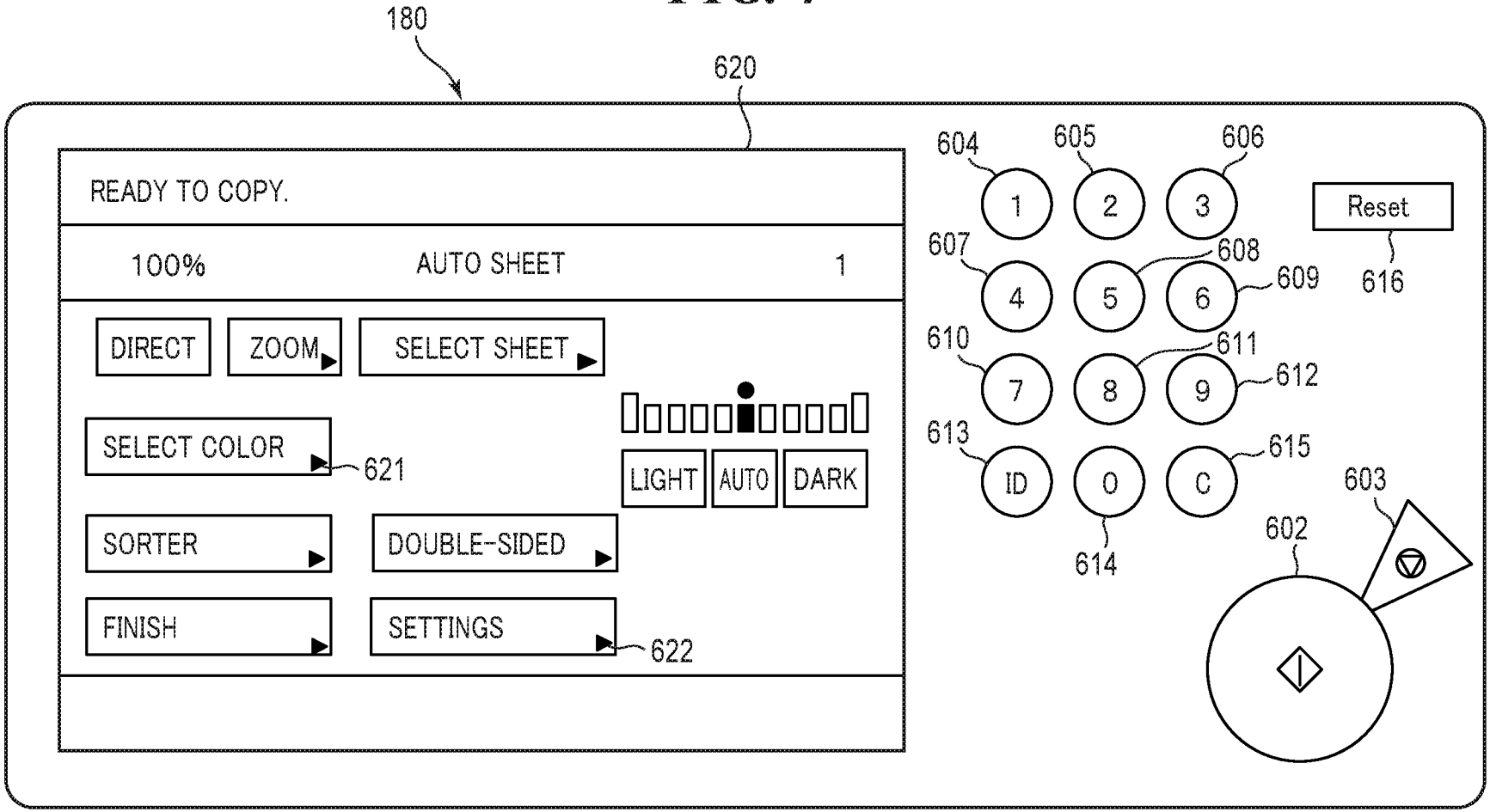
FIG. 4 is a view showing an arrangement of an operation display device.

FIG. 4 is a view showing an arrangement of the operation display device 180. A start key 602 for starting an image forming operation and a stop key 603 for causing an image forming operation to stop are disposed on the operation display device 180. Further, keys 604 to 612 and 614 of a numeric keypad for setting numerals and others, an ID key 613, a clear key 615, a reset key 616, and so forth are disposed on the operation display device 180. The operation display device 180 also has a display unit 620, on which a touch panel is formed so that software keys can be created on a screen. Selection of an image formation mode (color/monochrome) and setting of an operating mode in the monochrome mode (productivity prioritized (productivity priority mode)/image positional accuracy prioritized (image quality priority mode)) are implemented by input operations through the operation display device 180 by a user. The productivity priority mode is a mode in which priority is given to printing efficiency, and the image quality priority mode is a mode in which priority is given to image quality.

When a small amount of toner is consumed by forming a predetermined number of images (coverage rates are low), the image forming apparatus 100 suspends image formation to carry out the discharge control to refresh by consuming developers. For example, it is assumed that images with patterns of low coverage rates such as a yellow coverage rate of 2.0%, a magenta coverage rate of 1.0%, a cyan coverage rate of 1.5%, and a black coverage rate of 6.0% are sequentially formed. When the average coverage rate of any color is less than "2.0%", the image forming apparatus 100 carries out the discharge control such that developers (toner) are discharged so that the average coverage rate can be 2.0%. In the above example, since the magenta coverage rate is 1.0% and the cyan coverage rate is 1.5%, the image forming apparatus 100 discharges 1.0% magenta toner and discharges 0.5% cyan toner. Namely, the image forming apparatus 100 forms discharge patterns so that toner corresponding in amount to a predetermined number of sheets×1.0% can be discharged from a magenta developing device, and toner corresponding in amount to the predetermined number of sheets×0.5% can be discharged from a cyan developing device. In a sequence of the discharge control, the image forming apparatus 100 suspends image formation and discharges degraded toner by forming a discharge pattern. A bias applied to the primary transfer roller 107 is opposite in polarity to that of a bias for normal image formation based on a print job so that a toner image discharged as the discharge pattern can be removed by the drum cleaner 109.

Next, referring to flowcharts of FIGS. 6 to 10 and FIGS. 4, 5, and 11, a detailed description will be given of the discharge control (toner discharge sequences) by the CPU 901.

Figure 5A:
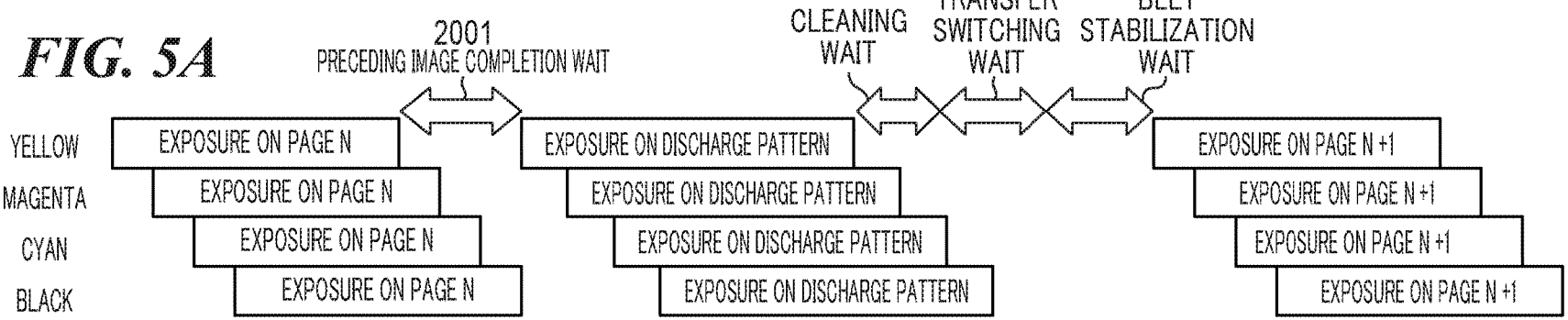
FIGS. 5A to 5C are time charts of discharge sequences.
Figure 5B:
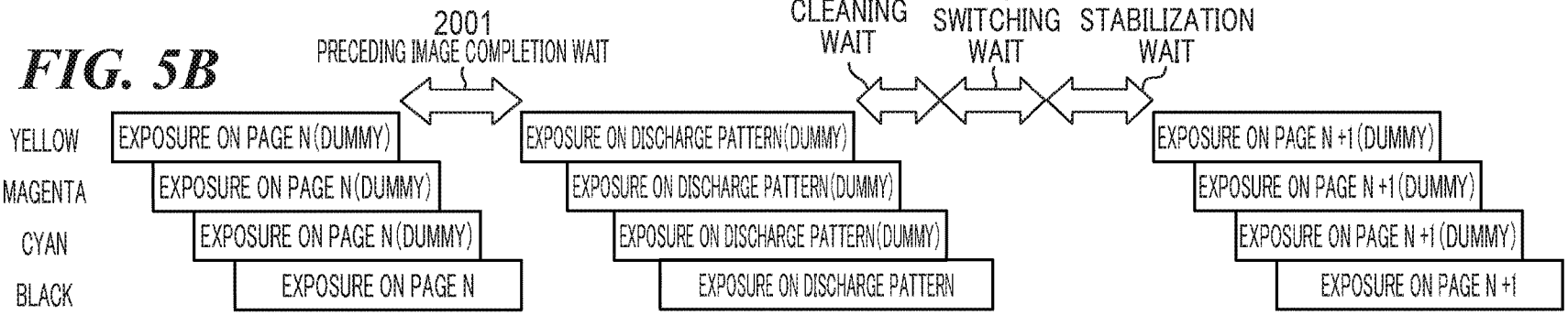
Figure 5C:
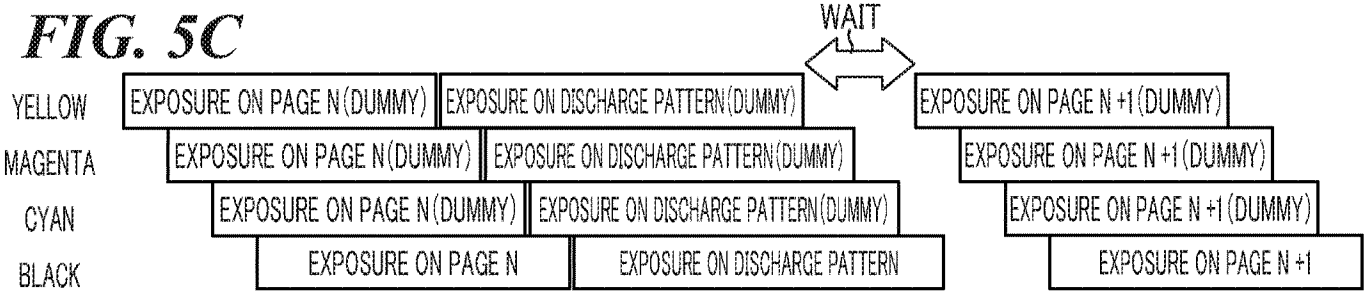

FIGS. 5A to 5C are time charts of discharge sequences. FIG. 5A shows a discharge sequence in a mixed color mode (color mode). FIGS. 5B and 5C show discharge sequences in cases where the operating mode in the monochrome mode is the productivity priority mode and the image positional accuracy priority mode, respectively. It should be noted that in FIGS. 5B and 5C, an exposure in the stations where no image or discharge patterns is formed is described as "exposure (dummy)".

Figure 6:
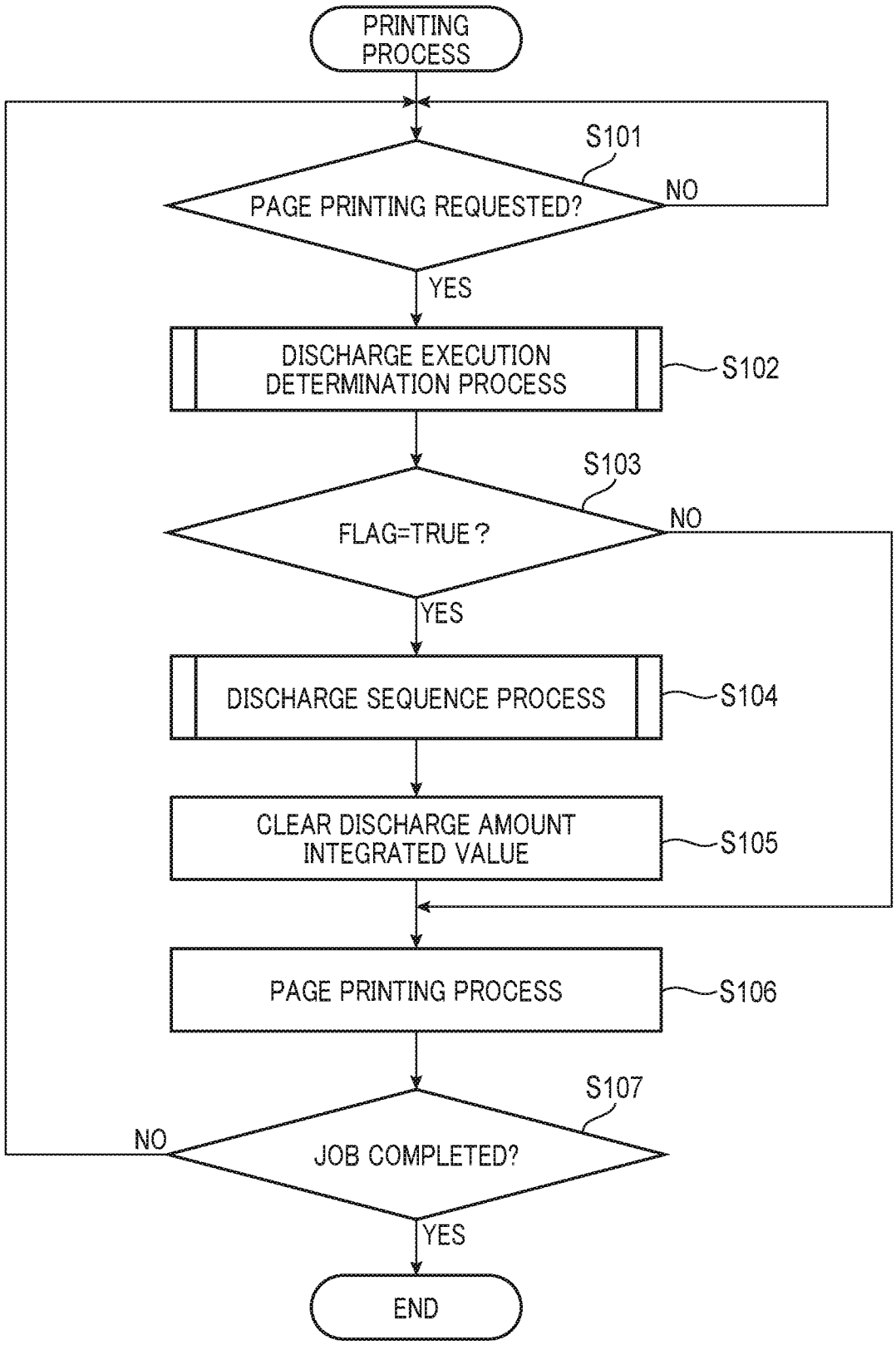
FIG. 6 is a flowchart of a printing process.

FIG. 6 is a flowchart of a printing process. The process in this flowchart is implemented by the CPU 901 reading out programs stored in the ROM 902 into the RAM 903 and executing them. Whether or not to carry out a discharging process changes between page printing and page printing. In the process in FIG. 6, the CPU 901 act as a control unit and a setting unit.

First, in step S101, the CPU 901 stands by until it receives a request for page printing based on a print job, that is, a print request, and when it receives the print request, the process proceeds to step S102, in which the CPU 102 in turn carries out a discharge execution determination process (FIG. 7), to be described later. It should be noted that image data as well as the print job is transferred from an external apparatus (a computer, a server, or a scanner) to the CPU 102. The image data includes data created using, for example, PDL (page-description language). In the discharge execution determination process (FIG. 7), FLAG which is a variable indicating whether or not execution of the discharge control is necessary is set to TRUE indicating that the execution is necessary or FALSE indicating that the execution is unnecessary. The variable FLAG is stored in the RAM 903.

In step S103, the CPU 901 determines whether or not a value of the variable FLAG is TRUE. When the value of the variable FLAG is not TRUE, the process proceeds to step S106 because the execution of the discharge control is unnecessary. On the other hand, when the value of the variable FLAG is TRUE, the process proceeds to step S104 because the execution of the discharge control is necessary. In the step S104, the CPU 901 carries out a discharge sequence process (FIG. 8), to be described later. In the discharge execution determination process (FIG. 7), discharge amount integrated values which are variables indicating required discharge amounts are calculated for the respective colors and stored in the RAM 903. The CPU 901 carried out the discharge control in the step S104, and hence in step S105, the CPU 901 clears the discharge amount integrated values for all the stations stored in the RAM 903 to zero. In step S106, the CPU 901 carries out a page printing process, and in step S107, the CPU 901 determines whether or not the print job has completely been processed. When the CPU 901 determines that the print job has not completely been processed, the process returns to the step S101, and then the CPU 901 determines that the print job has completely been processed, the CPU 901 ends the process in FIG. 6.

Figure 7:
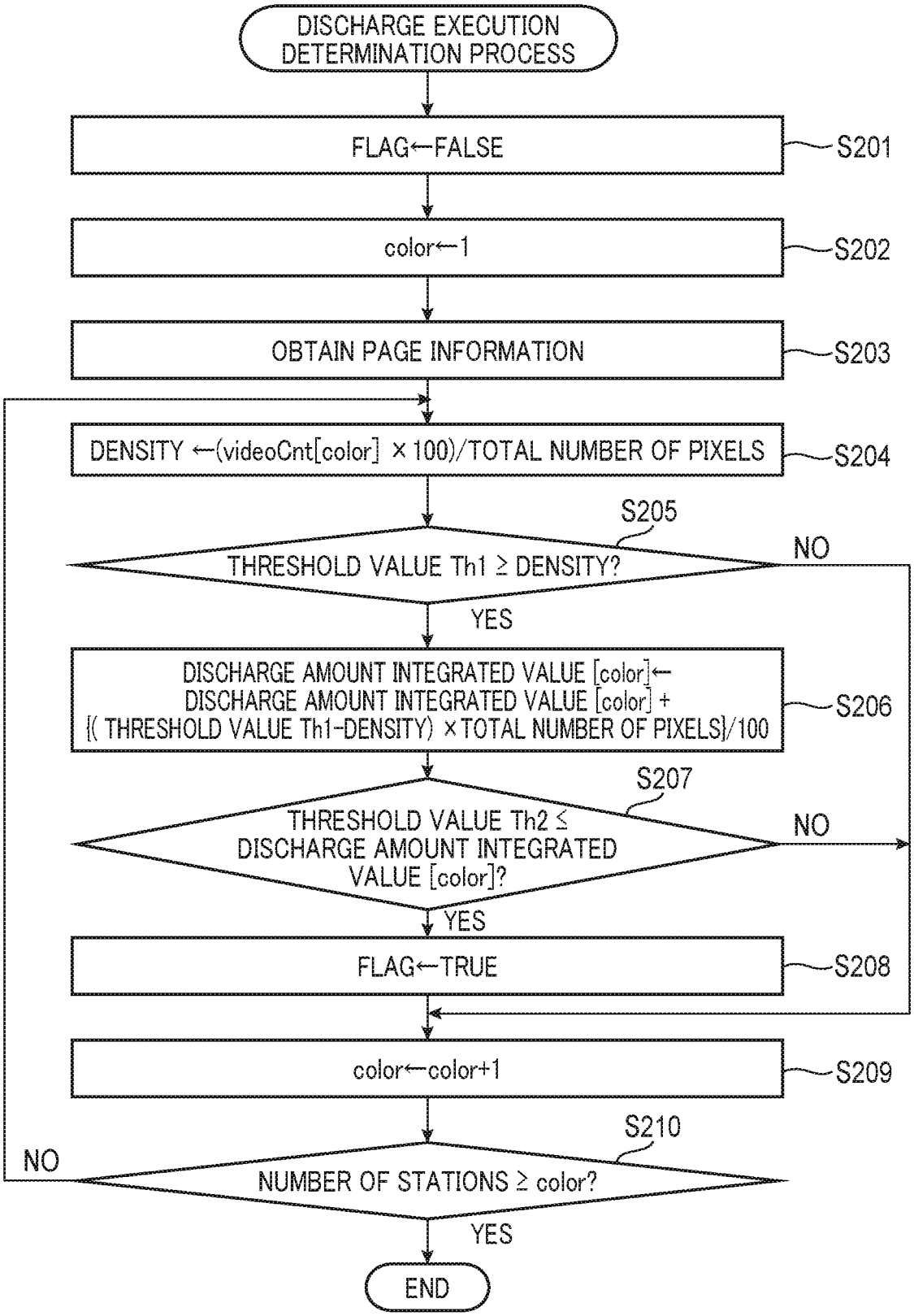
FIG. 7 is a flowchart of a discharge execution determination process.

FIG. 7 is a flowchart of the discharge execution determination process which is carried out in the step S102 in FIG. 6. In step S201, the CPU 901 resets a value of the variable FLAG to FALSE, and in step S202, the CPU 901 resets a value of a variable color to an initial value "1", the value of a variable color indicating an index of a color for which the discharge control is to be carried out. The variable color is stored in the RAM 903. It is assumed here that the variable color and the colors have the following relationships: 1:Y, 2:M, 3:C, and 4:K. For example, the initial value "1" of the variable color represents yellow.

Then, in step S203, the CPU 901 obtains information on an image for one page to be printed this time. Specifically, based on a result of analysis on image data, the CPU 901 determines information on the total number of pixels in the image for one page to be printed this time and the number of dots to be printed (on-dot number) in each station and obtains them as page information (image data). It is assumed that the number of dots to be printed in each station is stored as array type variables videoCnt [color] arranged on the RAM 903. Then, the CPU 901 calculates an image density of a color designated by the variable color. The CPU 901 calculates the image density and stores a result of the calculation in the RAM 903. The density [%] corresponds to a coverage rate of the image for one page to be printed this time.

$$\text{Density [\%]} = (\text{videoCnt[color]} \times 100)/\text{the total number of pixels} \quad \text{(Equation 1)}$$

In step S205, the CPU 901 determines whether or not a threshold value Th1 is equal to or greater than the density (coverage rate) calculated in the step S204 (the threshold value Th1≥the density). Here, the threshold value Th1 is a fixed value which is a target value representing a targeted coverage rate of "2.0%". The threshold value Th1, however, may be changed by a maintenance person or changed according to installation environments. As a result of the determination in the step S205, when the threshold value Th1≥the density does not hold, the CPU 901 determines that it is unnecessary to update the discharge amount integrated value with respect to the station for which the density has been calculated this time, and hence the process proceeds to step S209. On the other hand, when the threshold value Th1≥the density holds, the CPU 901 determines that it is necessary to update the discharge amount integrated value with respect to the station for which the density has been calculated this time, and hence the process proceeds to step S206.

In the step S206, the CPU 901 updates the discharge amount integrated value [color] using an equation 2 below based on the density (coverage rate) of the image for one page to be printed this time and stores the updated discharge amount integrated value [color] in the RAM 903.

$$\text{Discharge amount integrated value[color]} = \text{discharge amount integrated value [color]} + \{(\text{threshold value Th1} - \text{density}) \times \text{the total number of pixels}\}/100 \quad \text{(Equation 2)}$$

The discharge amount integrated value [color] corresponds to the total number of pixels which is a shortfall in a target coverage rate. In other words, the discharge amount integrated value [color] corresponds to a value obtained by adding up differences between the number of pixels forming an electrostatic image per page and a target value. Here, "the total number of pixels" represents the total number of pixels on a page targeted this time.

Then, in step S207, the CPU 901 determines whether or not the discharge amount integrated value [color] is equal to or greater than a threshold value Th2 (the threshold value Th2≤the discharge amount integrated value [color]). Here, the threshold value Th2 is a value corresponding to the total number of pixels in a discharge pattern and is a fixed value. The threshold value Th2 may also be changed by a maintenance person or changed according to installation environments. It should be noted that when a discharge amount integrated value from a previous discharge has reached the threshold value Th2, it is determined that a developer has degraded. When the CPU 901 determines that the threshold value Th2≤the discharge amount integrated value [color] does not hold, the process proceeds to the step S209. On the other hand, when the threshold value Th2≤the discharge amount integrated value [color] holds, the CPU 901 determines that the developer has degraded, and hence the CPU 901 executes step S208, followed by the process proceeding to the step S206. In the step S208, the CPU 901 sets the variable FLAG to TRUE. Thus, whether or not to carry out the discharge control is determined based on the discharge amount integrated value [color].

In the step S209, the CPU 901 adds one to the variable color so that the variable color can be a value for a next color. Then, in step S210, the CPU 901 determines whether or not the variable color has exceeded the number of stations. When the variable color has not exceeded the number of stations, the process returns to the step S204 because there is an unprocessed station regarding the page to be printed this time. On the other hand, when the variable color has exceeded the number of stations, processing on all the stations has been completed for the page to be printed this time, and hence the CPU 901 ends the process in FIG. 7.

Figure 8:
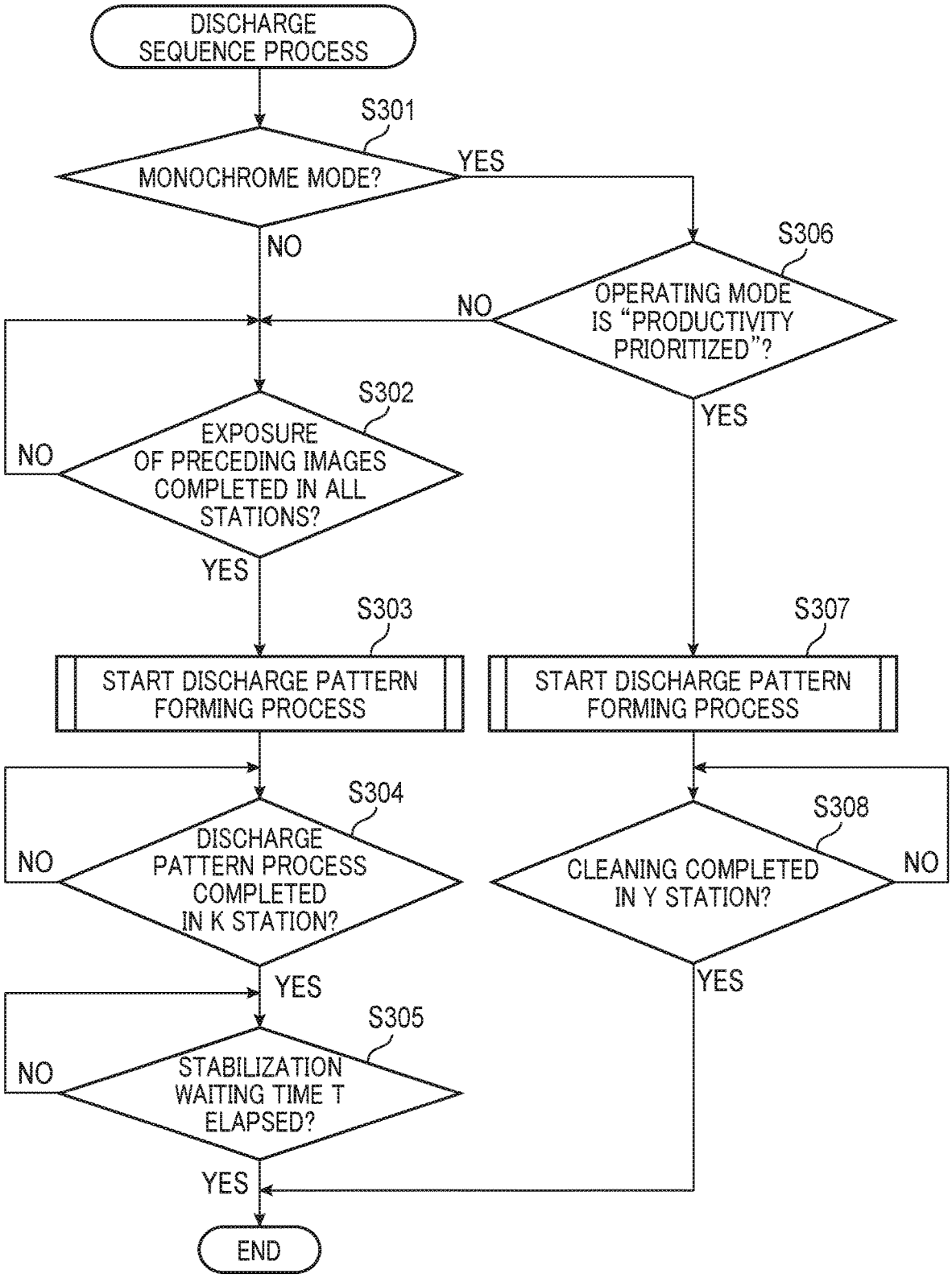
FIG. 8 is a flowchart of a discharge sequence process.

FIG. 8 is a flowchart of the discharge sequence process which is carried out in the step S104 in FIG. 6. In the following description, a page on which an image is formed immediately before certain discharge control is designated as a preceding page N, and a page on which an image is formed immediately after the discharge control is designated as a succeeding page N+1. Thus, the discharge control is carried out between the preceding page N and the succeeding page N+1. FIGS. 5 and 11 will also be referred to in the following description as the need arises.

Figure 11A:
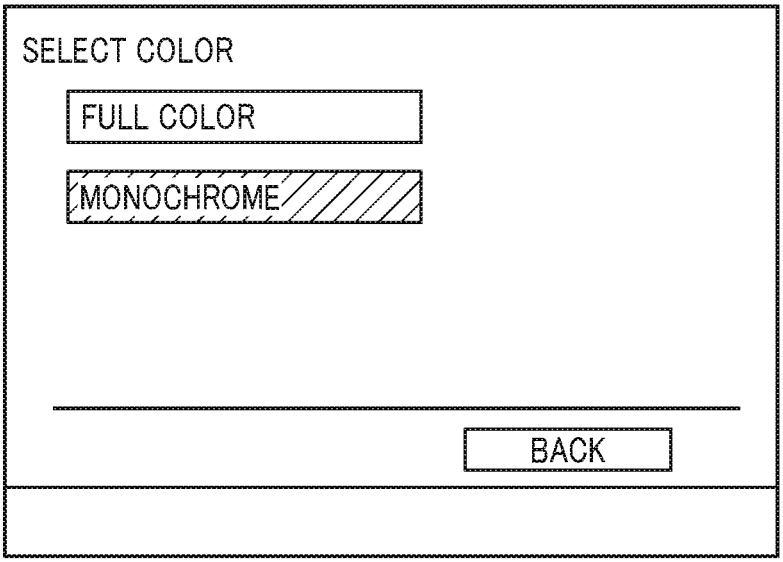
FIGS. 11A to 11C are views showing display examples of a mode setting screen, a setting menu screen, and a selection screen, respectively.

First, in step S301, the CPU 901 determines whether or not an image formation mode for a print job this time is the monochrome mode. Here, the user can set the image formation mode from the display unit 620 of the operation display device 180 in FIG. 4. When the user depresses a "color selection key" 621 which is a software key on the display unit 620, a mode setting screen in FIG. 11A is displayed. On this mode setting screen, when the user depresses "monochrome", the monochrome mode can be set. When the user depresses "full color", the mixed color mode can be set. Alternatively, the image formation mode can also be set when a print job is submitted from the computer 906.

The monochrome mode is a mode in which a monochrome image is formed using only one of the multiple stations. The mixed color mode is a mode in which a mixed color image is formed using two or more of the stations. It should be noted that although in the present embodiment, black is used in the monochrome mode, this is not limitative, but any one color other than black is used in the monochrome mode. Moreover, the number of stations for use in the mixed color mode has only to be two or more, and the number of stations which the image forming apparatus 100 has may be five or more. The user can designate colors for use in the mixed color mode. It should be noted that in an image forming operation performed by the image forming apparatus 100 in the monochrome mode using black, the stations other than the black station operates in the same manner as in the mixed color mode except that image data received from the image control unit 922 is blank data.

When the CPU 901 determines in the step S301 that the image formation mode is not the monochrome mode, this means that the image formation mode is the mixed dolor mode, and hence the process proceeds to step S302. On the other hand, when the CPU 901 determines in the step S301 that the image formation mode is the monochrome mode, the process proceeds to step S306, in which the CPU 901 in turn determines whether or not an operating mode in the monochrome mode is "productivity prioritized". When the CPU 901 determines that the operating mode is not "productivity prioritized", this means that the operating mode is "image positional accuracy prioritized", and hence the process proceeds to the step S302, and on the other hand, when the CPU 901 determines that the operating mode is "productivity prioritized", the process proceeds to the step S307.

When the process proceeds from the step S301 to the step S302, the discharge sequence (FIG. 5A) in the mixed color mode is performed in the steps S302 to S305. When the process proceeds from the step S306 to the step S302, the discharge sequence (FIG. 5B) with image positional accuracy prioritized in the monochrome mode is performed in the steps S302 to S305. When the process proceeds from the step S306 to the step S307, the discharge sequence (FIG. 5C) with productivity prioritized in the monochrome mode is performed in the steps S307 and S308. A sequence mode in which the steps S303 to S305 are performed is a "first mode", and a sequence mode in which the steps S307 and S308 are performed is a "second mode". Thus, the CPU 901 selectively sets the first mode and the second mode. It should be noted that as far as insertion of blanks (waiting periods) is concerned, the discharge sequences in FIGS. 5A and 5B are the same. Also, as far as insertion of the blanks is concerned, the discharge sequence in FIG. 5B is the same as in a conventional monochrome mode.

In the step S302, the CPU 901 waits until exposure on the preceding page N by the lasers 108 is completed in all the stations (the station 123 for black at which exposure is performed last in the present embodiment). As a result, a succeeding image completion wait 2001 is inserted as a blank before formation of discharge patterns. When exposure on the preceding page N by the lasers 108 is completed in all the stations, the CPU 901 carries out a discharge pattern forming process (FIG. 9), to be described later (step S303), followed by the process proceeding to the step S304.

The steps S304 and S305 are processing steps for providing blanks between the formation of the discharge patterns and the formation of the image on the succeeding page N+1. Specifically, the CPU 901 provides control to insert a transfer switching wait 2003 and a belt stabilization wait 2004 shown in FIG. 5A or 5B as the blanks. Namely, in the step S304, the CPU 901 waits until completion of a discharge pattern station process in the black station 123, to be described later (completion of step S506 in FIG. 10 in step S407 in FIG. 9). As a result, the cleaning wait 2002 and the transfer switching wait 2003 are inserted as the blanks as illustrated in FIGS. 5A and 5B. After that, when the discharge pattern station process in the black station 123 is completed, the CPU 901 waits for a predetermined stabilization wait time T (for example, two seconds) to elapse (step S305). As a result, the belt stabilization wait 2004 is inserted as the blank as illustrated in FIGS. 5A and 5B. When the stabilization wait time T has elapsed, the process in FIG. 8 is ended.

In the step S307, the CPU 901 carries out the discharge pattern forming process (FIG. 9), to be described later, followed by the process proceeding to the step S308. The step S308 is a processing step for waiting until a time to form the image on the succeeding page N+1 comes after the discharge patterns are formed. Specifically, in the step S308, the CPU 901 waits for a cleaning process (step S505 in FIG. 10 in step S401 in FIG. 9) to be completed in the yellow station 120 for which the order of operation is the first. As a result, the cleaning wait 2002 is inserted as a blank between the formation of the discharge patterns and the formation of the image on the succeeding page N+1 as illustrated in FIG. 5C. When the cleaning process is completed, the process in FIG. 8 is ended.

Here, the two modes consisting of the productivity prioritized mode and the image positional accuracy prioritized mode are provided in the monochrome mode for reasons below. First, in the image forming apparatus 100, when biases for the primary transfer rollers 107 are switched, the intermediate transfer belt 106 is shifted several dozen μm at the maximum in a main scanning direction. Color misregistration never occurs in image formation using a single station as in the monochrome mode. On the other hand, an image may be shifted several dozen μm at the maximum with respect to the recording sheet 110. This amount of shift is small in terms of the order of accuracy required for an image position with respect to the recording sheet 110, but the image positional accuracy prioritized mode is offered for users who request for higher accuracy. Even in the monochrome mode, the same image positional accuracy as in the past is realized by securing the waiting time (belt stabilization wait 2004) as in the past before the intermediate transfer belt 106 is stabilized after the discharge patterns are formed.

Figure 11B:
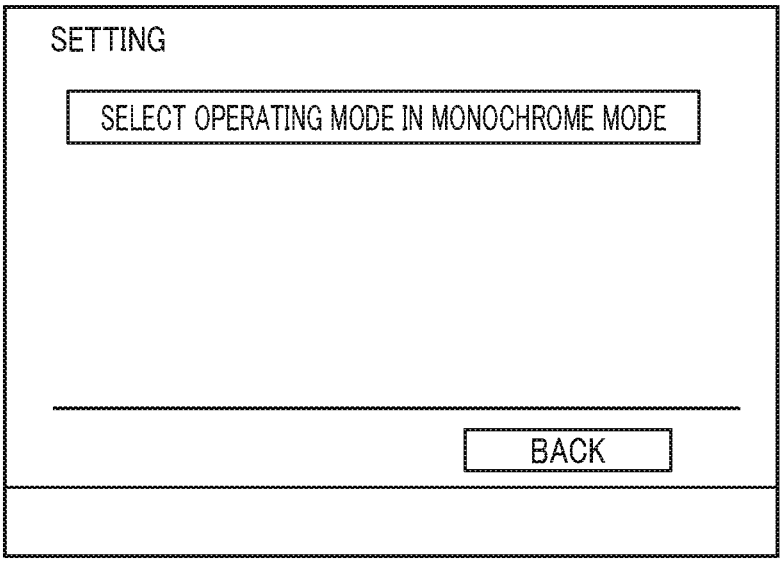
Figure 11C:
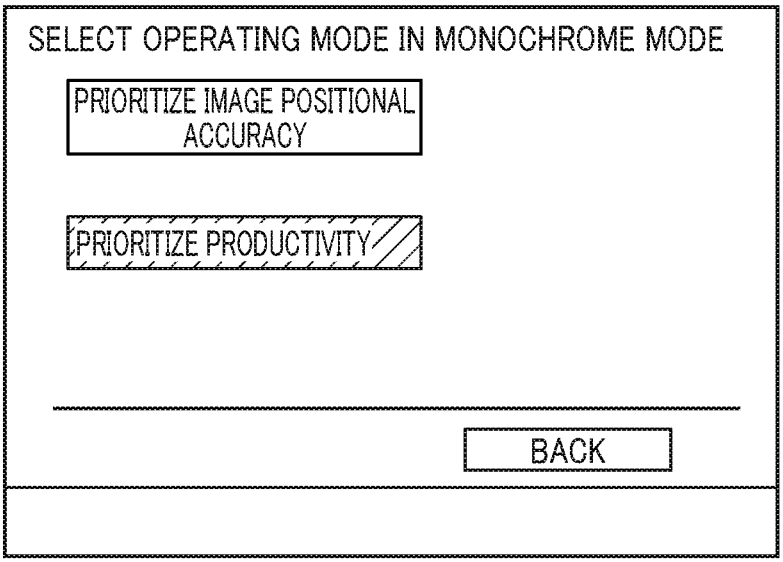

On the display unit 620 of the operation display device 180 in FIG. 4, "productivity prioritized" or "image positional accuracy prioritized" is selected. When the user depresses a setting 622 which is a software key, a setting menu screen shown in FIG. 11B is displayed. When the user further depresses a "select operation mode in monochrome mode" key, a selection screen shown in FIG. 11C is displayed, and "productivity prioritized" or "image positional accuracy prioritized" is selectable on this selection screen. It should be noted that in the present embodiment, "productivity prioritized" is set as a default. It should be noted that the step S306 may be dispensed with. For example, in the monochrome mode, productivity may always be prioritized, and the process may proceed to step S307.

Figure 9:
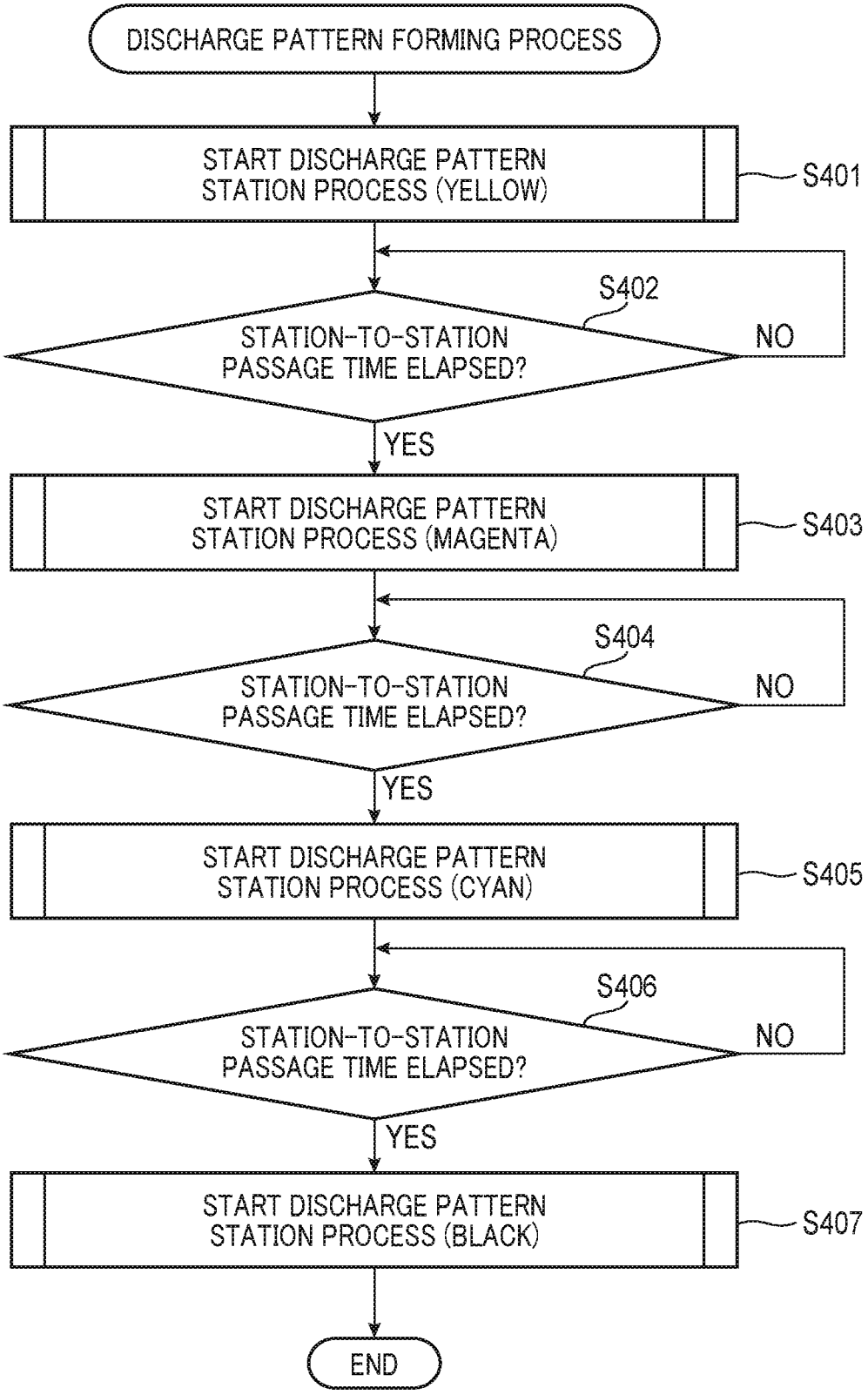
FIG. 9 is a flowchart of a discharge pattern forming process.

FIG. 9 is a flowchart of the discharge pattern forming process in each station. This process is carried out in the step S303 or S307 in FIG. 8. First, in the step S401, the CPU 901 starts a discharge pattern station process (FIG. 10) in the yellow station 120. Next, in step S402, the CPU 901 waits for a station-to-station passage time to elapse. Namely, the CPU 901 waits for the discharge pattern station process to be started in the magenta station 121. Here, the station-to-station passage time is calculated by dividing a distance between adjacent stations by a process speed time. For example, the station-to-station passage time between the Y and M stations is calculated by dividing a distance between the Y and M stations by the process speed time.

When the station-to-station passage time between the Y and M stations has elapsed, the CPU 901 starts the discharge pattern station process (FIG. 10) in the magenta station 121. Next, in step S404, the CPU 901 waits for a station-to-station passage time between the M and C stations to elapse. When the station-to-station passage time between the M and C stations has elapsed, the CPU 901 starts the discharge pattern station process (FIG. 10) in the cyan station 122. Then, in step S406, the CPU 901 waits for a station-to-station passage time between the C and K station to elapse. When the station-to-station passage time for passage between the C and K stations has elapsed, the CPU 901 starts the discharge pattern station process (FIG. 10) in the station black 123 and ends the process in FIG. 9.

Figure 10:
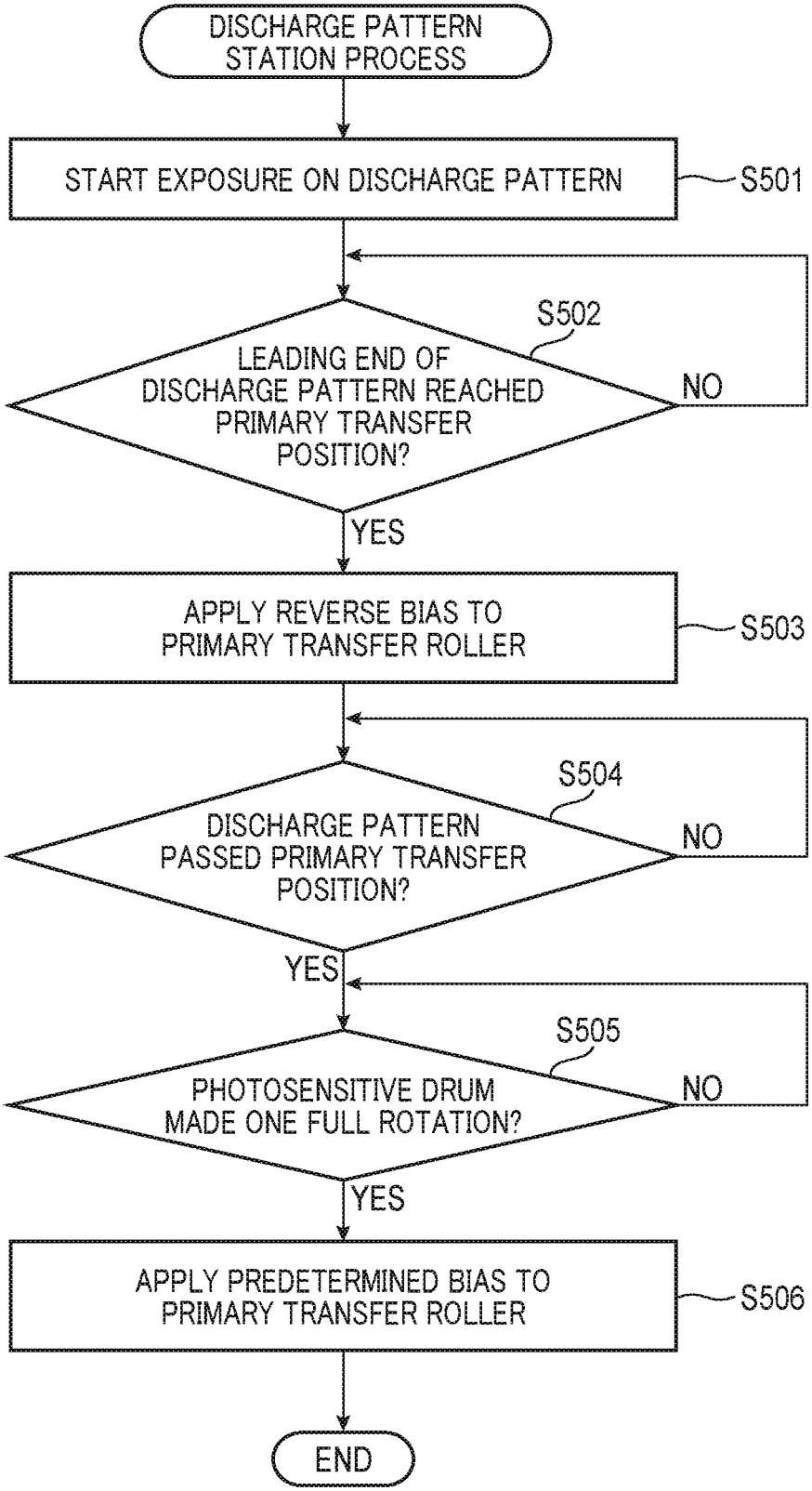
FIG. 10 is a flowchart of a discharge pattern station process.

FIG. 10 is a flowchart of the discharge pattern station process in one station, which is consisted of steps of discharge pattern exposure, primary transfer, and cleaning in one station. The discharge pattern station process is started in each of steps S401, S403, S405, and S407 in FIG. 9 and may be carried out in parallel in the four stations.

In the following description with reference to FIG. 10, a station in which a discharge pattern is to be formed is referred to as a station to be processed. It should be noted that in the process in FIG. 10, an operation performed in stations other than the station to be processed in the monochrome mode is a "dummy exposure". In this case, the CPU 901 performs an exposure based on image data corresponding to a blank sheet.

First, in step S501, the CPU 901 starts an exposure for forming a discharge pattern on the photosensitive drum 105. Next, in step S502, the CPU 901 waits for a leading end of the discharge pattern on the photosensitive drum 105 to reach a primary transfer position (a position at which the photosensitive drum 105 and the primary transfer roller 107 face each other). When the leading end of the discharge pattern on the photosensitive drum 105 has reached the primary transfer position, the CPU 901 controls the voltage control unit 311 in step S503 to apply a reverse bias to the primary transfer roller 107. As a result, the discharge pattern (the toner image on the photosensitive drum 105) remains on the photosensitive drum 105 without being transferred to the intermediate transfer belt 106.

Then, in step S504, the CPU 901 waits for a trailing end of the discharge pattern on the photosensitive drum 105 to pass the primary transfer position, and when the trailing end of the discharge pattern on the photosensitive drum 105 has passed the primary transfer position, the process proceeds to the step S505. In the step S505, the CPU 901 waits for the photosensitive drum 105 to make one full rotation so as to clean the photosensitive drum 105 by removing the toner remaining as the discharge pattern on the photosensitive drum 105 with the drum cleaner 109. Upon detecting that a time period required for the full rotation of the photosensitive drum 105 has elapsed, the CPU 901 determines that the remaining toner has been removed, and hence the process proceeds to the step S506. As a result, the cleaning wait 2002 is inserted as the blank. It should be noted that in the step S308 in FIG. 8, upon detecting that the process in the step S505 has been completed in the yellow station 120, the CPU 901 provides control to determine that the result is positive (yes).

In the step S506, the CPU 901 applies a predetermined bias (positive bias) to the primary transfer roller 107 by controlling the high voltage control unit 311 so that the primary transfer roller 107 goes back to its original state before formation of the discharge pattern. It should be noted that in the step S304 in FIG. 8, upon detecting that the process in the step S506 has been completed in the black station 123, the CPU 901 provides control to determine that the result is positive (yes).

The control according to the flowcharts of FIGS. 6 to 10 described above will now be described again with reference to FIGS. 5B and 5C from the standpoint of discharge control and image formation timings.

First, based on whether the sequence mode is the first mode or the second mode, the CPU 901 controls the start timing of discharge control with respect to the end timing of formation of electrostatic images in image formation (the preceding page N) immediately before the discharge control. Specifically, in the first mode, the CPU 901 starts the discharge control after waiting until formation of electrostatic images for image formation (the preceding page N) immediately before the discharge control is completed in all the stations as shown in FIG. 5B. As a result, the preceding image completion wait 2001 is provided between the preceding page N and the discharge control, and hence satisfactory image quality is maintained. On the other hand, in the second mode, the CPU 901 starts the discharge control without waiting for the formation of electrostatic images during image formation (the preceding page N) immediately before the discharge control to be completed in all the stations as shown in FIG. 5C. In particular, the CPU 901 starts the discharge control when the formation of the electrostatic image for the preceding page N is completed in the first station 120. As a result, the preceding image completion wait 2001 is omitted, which increases productivity.

Thus, when productivity is prioritized in the monochrome mode, the CPU 901 provides control such that intervals between images formed based on a print job and succeeding discharge patterns for discharge control are shorter than in the case where the mixed color mode is set. Moreover, when productivity is prioritized in the monochrome mode, the CPU 901 provides control such that intervals between images formed based on a print job and succeeding discharge patterns for discharge control are shorter than in the case where the image positional accuracy is prioritized in the monochrome mode.

It should be noted that even in the case where the preceding image completion wait 2001 is not provided, there may be a time lag between the time when the formation of the electrostatic image for the succeeding page N is completed in the first station 120 and the time when the discharge control is started in the first station 120.

Moreover, based on whether the sequence mode is the first mode or the second mode, the CPU 901 controls the start timing of formation of electrostatic images in image formation (the succeeding page N+1) immediately after discharge control with respect to the end timing of the discharge control. Specifically, in the first mode, as shown in FIG. 5B, the CPU 901 waits until the bias applied to the primary transfer rollers 107 is switched in the first station 120 from one for discharge control (reverse bias) to one for image formation (positive bias) immediately after the discharge control. Moreover, after switching the bias, the CPU 901 starts the formation of the electrostatic images for the succeeding page N+1 immediately after the discharge control after waiting for a predetermined time period (stabilization waiting time period T) to elapse. As a result, the transfer switching wait 2003 and the belt stabilization wait 2004 are provided between the discharge control and the succeeding page N+1, and hence satisfactory image quality is maintained. On the other hand, in the second mode, the CPU 901 starts the formation of the electrostatic images for the succeeding page N+1 without waiting for the bias applied to the primary transfer rollers 107 to be switched in the first station 120 from the reverse bias to the positive bias immediately after the discharge control (FIG. 5C). In particular, the CPU 901 starts the formation of the electrostatic image for the succeeding page N+1 in the first station 120 when removal of the developer on the photosensitive drum 105 is completed in the first station 120. As a result, the transfer switching wait 2003 and the belt stabilization wait 2004 are omitted, which increases productivity.

Thus, when productivity is prioritized in the monochrome mode, the CPU 901 provides control such that intervals between discharge patterns and succeeding images formed based on a print job are shorter than in the case where the mixed color mode is set. Moreover, when productivity is prioritized in the monochrome mode, the CPU 901 provides control such that intervals between discharge patterns and succeeding images formed based on a print job are shorter than in the case where the image positional accuracy is prioritized in the monochrome mode.

It should be noted that even in the case where the transfer switching wait 2003 or the like is not provided, there may be a time lag between the time when removal of the developer on the photosensitive drum 105 is completed in the first station 120 and the time when the formation of the electrostatic image for the succeeding page "N+1" is started in the first station 120.

According to the present embodiment, when productivity is prioritized in the monochrome mode, intervals between images formed based on a print job and succeeding discharge patterns for discharge control are shorter than in the case where the mixed color mode is set. Also, intervals between discharge patterns and succeeding images formed based on a print job are shorter than in the case the mixed color mode is set.

On the other hand, when productivity is prioritized in the monochrome mode, intervals between images formed based on a print job and succeeding discharge patterns for discharge control are shorter than image positional accuracy is prioritized in the monochrome mode. Also, intervals between discharge patterns and succeeding images formed based on a print job are shorter than in the case image positional accuracy is prioritized in the monochrome mode.

Namely, at the time of image formation based on a print job, the CPU 901 forms images on the recording sheet 110, and at the time of discharge control for consuming degraded developers by discharging the developers, suspends the image formation based on the print job and causes the developers 112 to discharge the developers. Based on the sequence mode, the CPU 901 controls the start timing of discharge control with respect to the end timing of formation of electrostatic images in image formation immediately before the discharge control. Also, based on the sequence mode, the CPU 901 controls the start timing of formation of electrostatic images in image formation immediately after discharge control with respect to the end timing of formation of electrostatic images in the discharge control. Therefore, maintenance of image quality accuracy or improvement of efficiency can be selected.

It should be noted that although in the control according to the present embodiment, intervals between discharge patterns and images formed based on a print job are distances, they may be time intervals.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-017362, filed Feb. 2, 2018, which is hereby incorporated by reference herein in its entirety.

What is claimed is:

1. An image forming apparatus comprising:

a first image forming unit configured to form a black image on a first photosensitive body with a black developer;

a second image forming unit configured to form a color image on a second photosensitive body with a color developer;

an intermediate transfer body;

a first primary transfer unit configured to transfer the black image from the first photosensitive body onto the intermediate transfer body;

a second primary transfer unit configured to transfer the color image from the second photosensitive body onto the intermediate transfer body;

a secondary transfer unit configured to transfer the black image and the color image from the intermediate transfer body onto a sheet;

a photosensitive body cleaner configured to remove the black developer from the first photosensitive body; and a controller configured to:

execute a mixed color mode in which a mixed color image is formed using the first image forming unit and the second image forming unit;

execute a monochrome mode in which a monochrome image is formed using the first image forming unit without using the second image forming unit;

control, in a case where a plurality of images are formed on a plurality of sheets, whether or not to form a black pattern by the first image forming unit to discharge a deteriorated black developer;

control, in a case where a first black pattern is formed between a N-th black image for a N-th mixed color image to be transferred onto a N-th sheet and a (N+1)-th black image for a (N+1)-th mixed color image to be transferred onto a (N+1)-th sheet of the plurality of sheets on the first photosensitive body in the mixed color mode, the first image forming unit to form the (N+1)-th black image on the first photosensitive body after a first time period has elapsed from formation of the first black pattern on the first photosensitive body; and control, in a case where a second black pattern is formed between a N-th black image for a N-th monochrome image to be transferred onto a N-th sheet and a (N+1)-th black image for a (N+1)-th monochrome image to be transferred onto a (N+1)-th sheet of the plurality of sheets on the first photosensitive body in the monochrome mode, the first image forming unit to form the (N+1)-th black image on the first photosensitive body after a second time period being shorter than the first time period has elapsed from formation of the second black pattern on the first photosensitive body, wherein the black pattern is removed from the first photosensitive body with the photosensitive body cleaner, without being transferred on a sheet, and wherein N is a positive integer.

2. The image forming apparatus according to claim 1, wherein the secondary transfer unit includes a belt, a driving roller that rotates the belt, and a belt cleaner.

3. The image forming apparatus according to claim 1, wherein the first image forming unit forms the black image based on image data;

the second image forming unit forms the color image based on the image data;

the controller controls whether or not to form the black pattern based on the image data.

4. The image forming apparatus according to claim 1, further comprising another photosensitive body cleaner configured to remove the color developer from the second photosensitive body.

5. The image forming apparatus according to claim 1, wherein in the mixed color mode, the controller controls the first image forming unit to form the first black pattern between the N-th black image for the N-th mixed color image and the (N+1)-th black image for the (N+1)-th mixed color image on the first photosensitive body, and controls the second image forming unit to form a color pattern between a N-th color image to be transferred onto the N-th sheet and a (N+1)-th color image to be transferred onto the (N+1)-th sheet on the second photosensitive body.

6. The image forming apparatus according to claim 1, wherein the controller controls the first primary transfer unit on a basis of a first bias of a first polarity in a case where the black image is transferred by the first primary transfer unit onto the intermediate transfer body, and the controller controls the first primary transfer unit on a basis of a second bias of a second polarity being different from the first polarity in a case where the black pattern is removed from the first photosensitive body with the photosensitive body cleaner.

7. The image forming apparatus according to claim 1, wherein the controller controls, in a case where the first black pattern is formed between the N-th black image for the N-th mixed color image and the (N+1)-th black image for the (N+1)-th mixed color image on the first photosensitive body in the mixed color mode, the first image forming unit to form the first black pattern on the first photosensitive body after a predetermined time period has elapsed from formation of the N-th black image on the first photosensitive body; and control, in a case where the second black pattern is formed between the N-th black image for the N-th monochrome image to be transferred onto the N-th sheet and a (N+1)-th black image for the (N+1)-th monochrome image to be transferred onto the (N+1)-th sheet of the plurality of sheets on the first photosensitive body in the monochrome mode, the first image forming unit to form the second black pattern on the first photosensitive body before the predetermined time period has elapsed from formation of the N-th black image on the first photosensitive body.

* * * * *